US012471713B2

(12) United States Patent
McCord

(10) Patent No.: US 12,471,713 B2
(45) Date of Patent: Nov. 18, 2025

(54) CUSHION STORAGE SYSTEM

(71) Applicant: TACKLE TOPS, LLC, Palm City, FL (US)

(72) Inventor: William M. McCord, Palm City, FL (US)

(73) Assignee: Tackle Tops, LLC, Palm City, FL (US)

( * ) Notice: Subject to any disclaimer, the term of this patent is extended or adjusted under 35 U.S.C. 154(b) by 198 days.

(21) Appl. No.: 18/363,095

(22) Filed: Aug. 1, 2023

(65) Prior Publication Data

US 2024/0032697 A1 Feb. 1, 2024

Related U.S. Application Data

(60) Provisional application No. 63/370,033, filed on Aug. 1, 2022.

(51) Int. Cl.

| | |
|---|---|
| ***A47C 7/62*** | (2006.01) |
| ***A47C 7/02*** | (2006.01) |
| ***A47C 27/00*** | (2006.01) |
| ***B65D 1/34*** | (2006.01) |
| ***B65D 25/10*** | (2006.01) |

(52) U.S. Cl.

CPC ..... *A47C 7/628* (2018.08); *A47C 7/0213* (2018.08); *A47C 27/005* (2013.01); *B65D 1/34* (2013.01); *B65D 25/10* (2013.01)

(58) Field of Classification Search

CPC ..... A47C 7/628; A47C 7/0213; A47C 27/005; B65D 1/34; B65D 25/10

See application file for complete search history.

(56) References Cited

U.S. PATENT DOCUMENTS

| | | | | |
|---|---|---|---|---|
| 818,045 | A * | 4/1906 | Perry | A47C 7/383 5/643 |
| 2,865,433 | A * | 12/1958 | Warner | A47C 4/52 297/250.1 |
| 3,026,547 | A * | 3/1962 | Dollinger | B63C 9/08 441/115 |
| 4,116,310 | A * | 9/1978 | Shields | A45F 3/02 5/639 |
| 4,822,309 | A * | 4/1989 | Vandenberg | A45C 9/00 441/35 |
| 5,013,272 | A * | 5/1991 | Watkins | E02B 3/26 441/127 |
| 5,984,347 | A * | 11/1999 | Blanc-Rosset | B60N 3/004 280/727 |
| 6,079,599 | A * | 6/2000 | Nordstrom | A45F 4/02 224/155 |
| 6,951,035 | B2 * | 10/2005 | Kinchen | A47G 33/00 5/655.9 |
| 10,414,468 | B2 * | 9/2019 | Dennehy | B63B 29/04 |
| 2018/0141718 | A1 * | 5/2018 | Ahlström | B65D 81/3813 |

* cited by examiner

*Primary Examiner* — Milton Nelson, Jr.
(74) *Attorney, Agent, or Firm* — McHale & Slavin, P.A.

(57) ABSTRACT

A cushion storage device designed to engage with a secondary, independent structure, such as a cooler, to 1) allow for additional storage of items (independent of what may be stored in the independent structure), and 2) provide seating. When engaged with a cooler, an individual may store items inside of the cushion storage device and use the attached cushion storage device as a seat.

20 Claims, 18 Drawing Sheets

CUSHION STORAGE SYSTEM

CROSS REFERENCE TO RELATED APPLICATIONS

In accordance with 37 C.F.R. 1.76, a claim of priority is included in an Application Data Sheet filed concurrently herewith. Accordingly, the present invention claims priority to U.S. Provisional Patent Application No. 63/370,033, entitled "CUSHION STORAGE SYSTEM", filed on Aug. 1, 2022. The contents of the above referenced applications are incorporated herein by reference in its entirety.

FIELD OF THE INVENTION

The present inventive concepts relate to storage devices; and more particularly, to a cushion storage system that can be attached to independent structures, thereby providing additional storage and seating options.

BACKGROUND OF THE INVENTION

Storing useful items when away from a home always seems to be an issue. Storage is an issue, particularly when engaging in outdoor activities. When participating in a short excursion, such as camping or fishing, participants typically bring coolers to store various items, such as refreshments to keep one hydrated, food to stay nourished, and ice to keep the food at a safe temperature to prevent spoilage. Coolers are available in many sizes to accommodate large or small storage requirements. However, large coolers can be difficult to transport. More importantly, even if using larger coolers, items other than food, water, or ice may not be appropriate to place therein. For example, putting additional equipment, such as a flashlight or glasses, or sunscreen lotion bottles, into an ice chest may damage those items. Alternatively, even if some of those items are not damaged, users may not want such items in contact with the food, beverages, and/or ice stored within the cooler. Additional means of storing items are typically needed.

Embodiments of the invention address such need and are designed to work in combination with pre-existing devices or structures.

SUMMARY OF THE INVENTION

Embodiments of the invention are directed towards a cushion storage device. The cushion storage device is designed to engage with a secondary, independent structure, such as a cooler, to 1) allow for additional storage of items (independent of what may be stored in the independent structure), and 2) to provide seating. Accordingly, when engaged with a cooler, an individual may store items inside of the cushion storage device and use the attached cushion storage device as body support, i.e., a seat.

Accordingly, it is an objective of embodiments of the invention to provide a storage system.

It is a further objective of embodiments of the invention to provide a storage system that works in combination with other structures.

It is yet another objective of embodiments of the invention to provide a storage system that secures to a cooler.

It is a still further objective of embodiments of the invention to provide a storage system having an interior tray or storage area.

It is a further objective of embodiments of the invention to provide a storage system having a removable interior tray or storage area.

It is yet another objective of embodiments of the invention to provide a cushion/seat storage system.

It is a still further objective of embodiments of the invention to provide a cushion/seat storage system that works in combination with other structures.

It is a further objective of embodiments of the invention to provide a cushion/seat storage system that secures to a cooler.

It is a further objective of embodiments of the invention to provide a cushion/seat storage system that converts a cooler into a comfortable seat with added storage, separate from the internal storage of the cooler.

It is yet another objective of embodiments of the invention to provide a cushion/seat storage system having an interior tray or storage area.

It is a still further objective of embodiments of the invention to provide a cushion/seat storage system having a removable interior tray or storage area.

It is a further objective of embodiments of the invention to provide a cushion/seat storage system with top access to storage compartments stored therein.

It is yet another objective of embodiments of the invention to provide a cushion/seat storage system with side access to storage compartments stored therein.

It is a still further objective of embodiments of the invention to provide a cushion/seat storage system which is removably securable to an independent structure.

It is a further objective of embodiments of the invention to provide a cushion/seat storage system with top access to storage compartments stored therein which is removably securable to an independent structure.

It is yet another objective of embodiments of the invention to provide a cushion/seat storage system with side access to storage compartments stored therein which is removably securable to an independent structure.

It is a still further objective of embodiments of the invention to provide a cushion/seat storage system which is removably securable to a cooler.

It is a further objective of embodiments of the invention to provide a cushion/seat storage system with top access to storage compartments stored therein which is removably securable to a cooler.

It is yet another objective of embodiments of the invention to provide a cushion/seat storage system with side access to storage compartments stored therein which is removably securable to a cooler.

Other objectives and advantages of this invention will become apparent from the following description taken in conjunction with any accompanying drawings wherein are set forth, by way of illustration and example, certain embodiments of this invention. Any drawings contained herein constitute a part of this specification, include exemplary embodiments of the present invention, and illustrate various objects and features thereof.

DETAILED DESCRIPTION OF THE INVENTION

Figure 1:
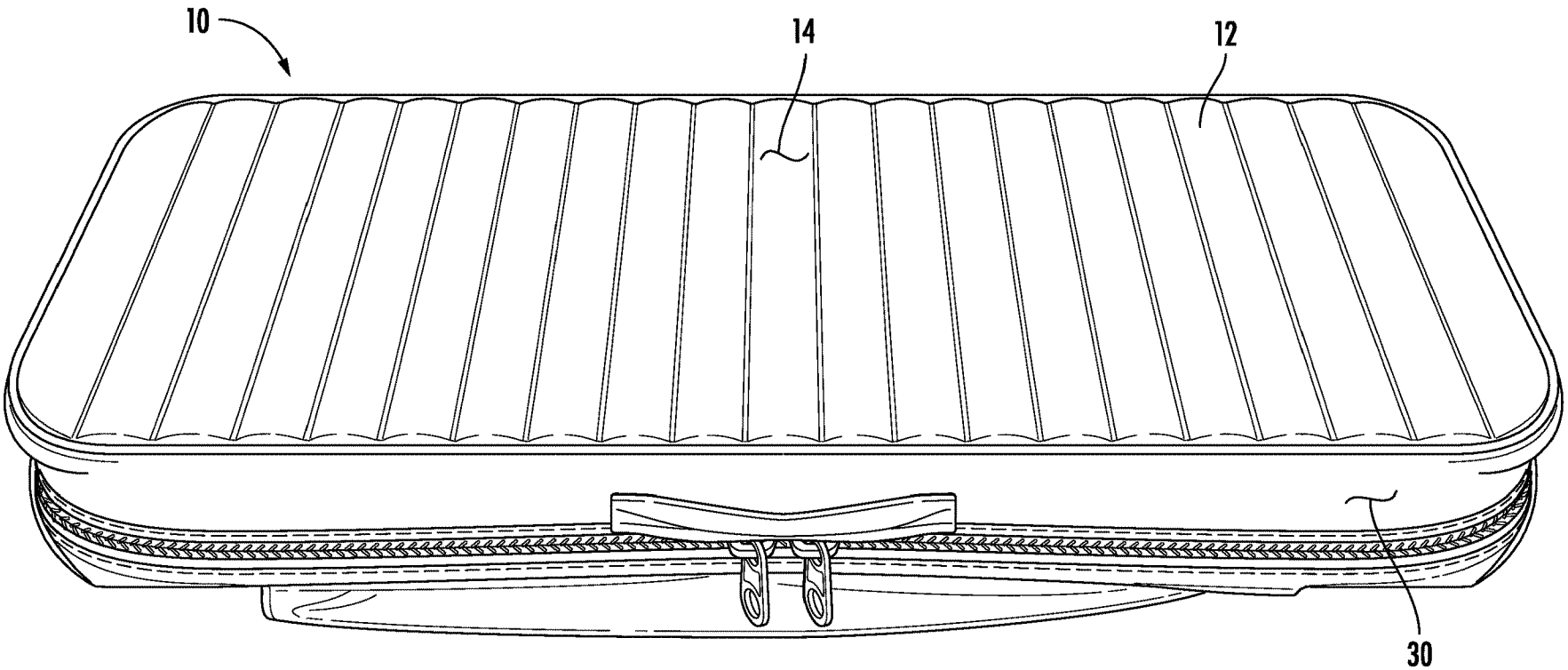
FIG. 1 is a perspective view of an illustrative embodiment of a cushion storage device.
Figure 2:
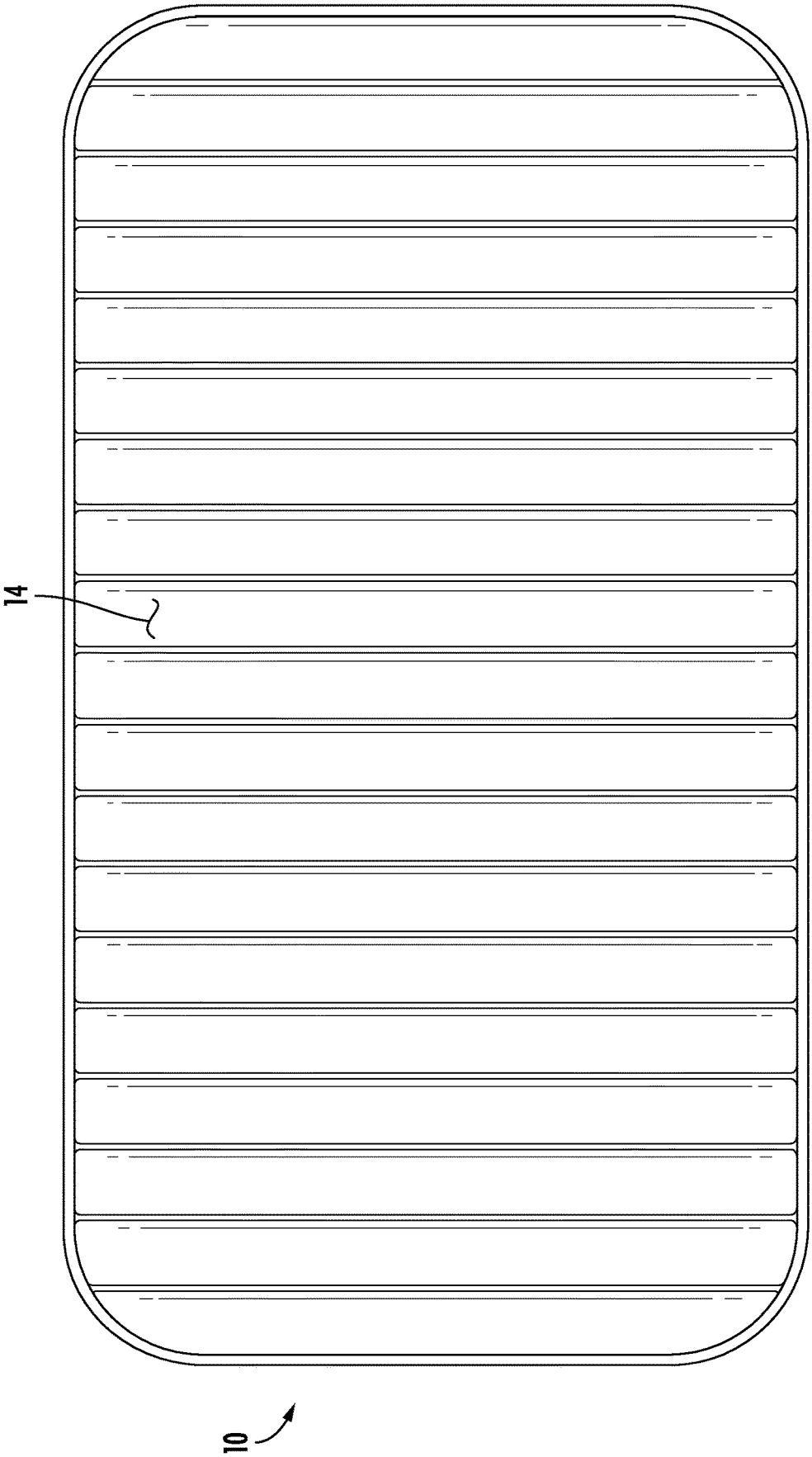
FIG. 2 is a top view of the cushion storage device.

While the present invention is susceptible of embodiment in various forms, there is shown in the drawings and will hereinafter be described a presently preferred, albeit not limiting, embodiment with the understanding that the present disclosure is to be considered an exemplification of the present invention and is not intended to limit the invention to the specific embodiments illustrated.

Referring to FIGS. 1-7, an illustrative embodiment of a storage device, referred to generally as a cushion storage device 10, is provided. Although the cushion storage device 10 is described and shown in use with a cooler, such use is illustrative only. The storage device 10 may be used with other structures, such as boat compartments, boat leaning posts. The cushion storage device 10 comprises a main body 12. The main body 12 has a first surface 14 (also referred to as an upper surface, i.e. the surface not in contact with a cooler when attached to the cooler) and a second, opposing surface 16 (also referred to as a lower surface, i.e. the surface in contact with a cooler when attached to the cooler).

Figure 4:
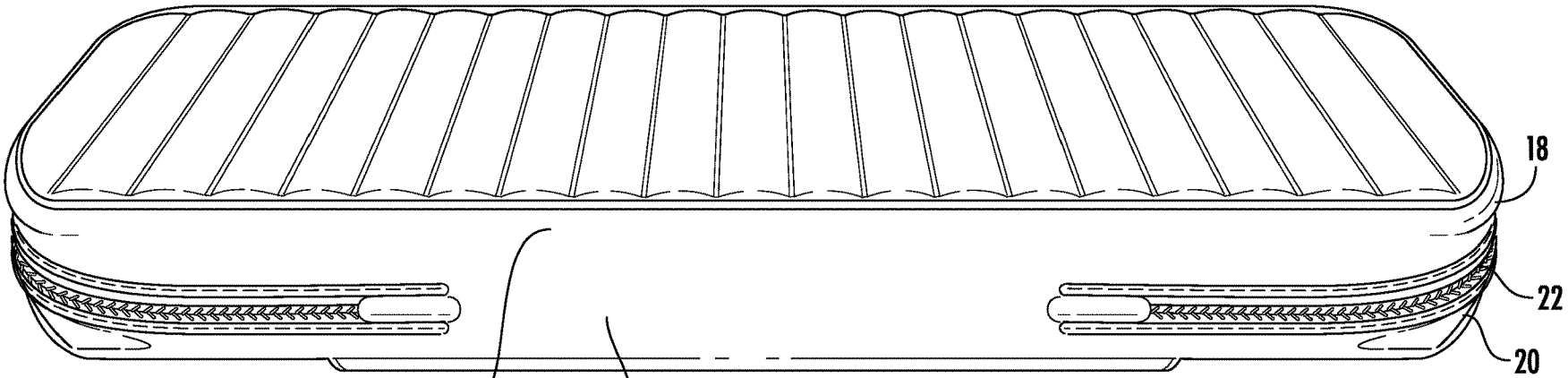
FIG. 4 is a back view of the cushion storage device.
Figure 5:
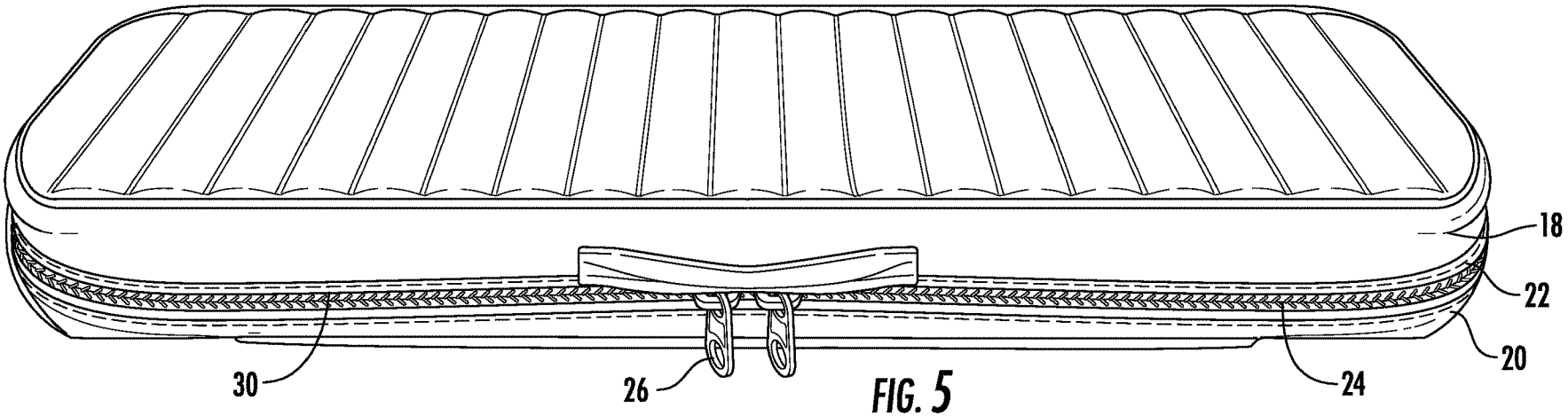
FIG. 5 is a front view of the cushion storage device.
Figure 6:
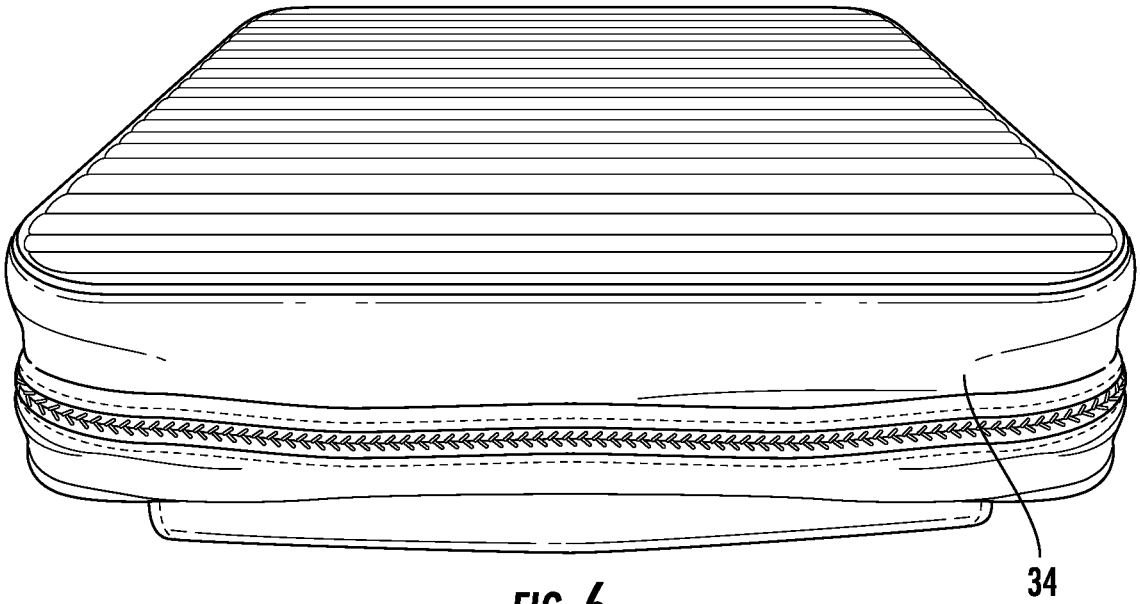
FIG. 6 is a side view of the right side of the cushion storage device.
Figure 7:
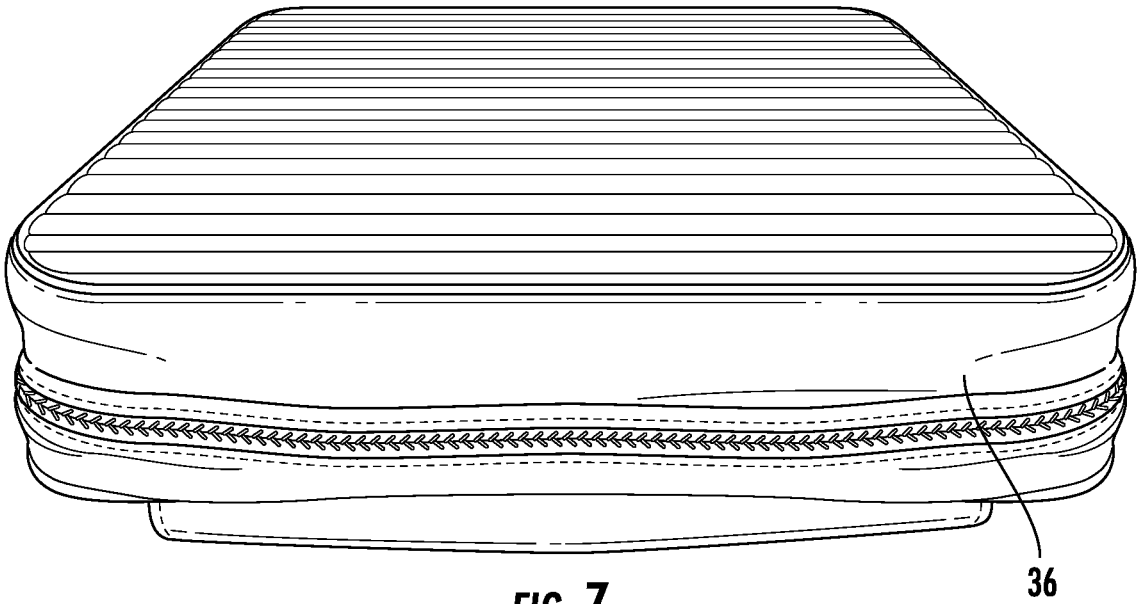
FIG. 7 is a side view of the left side of the cushion storage device.
Figure 8A:
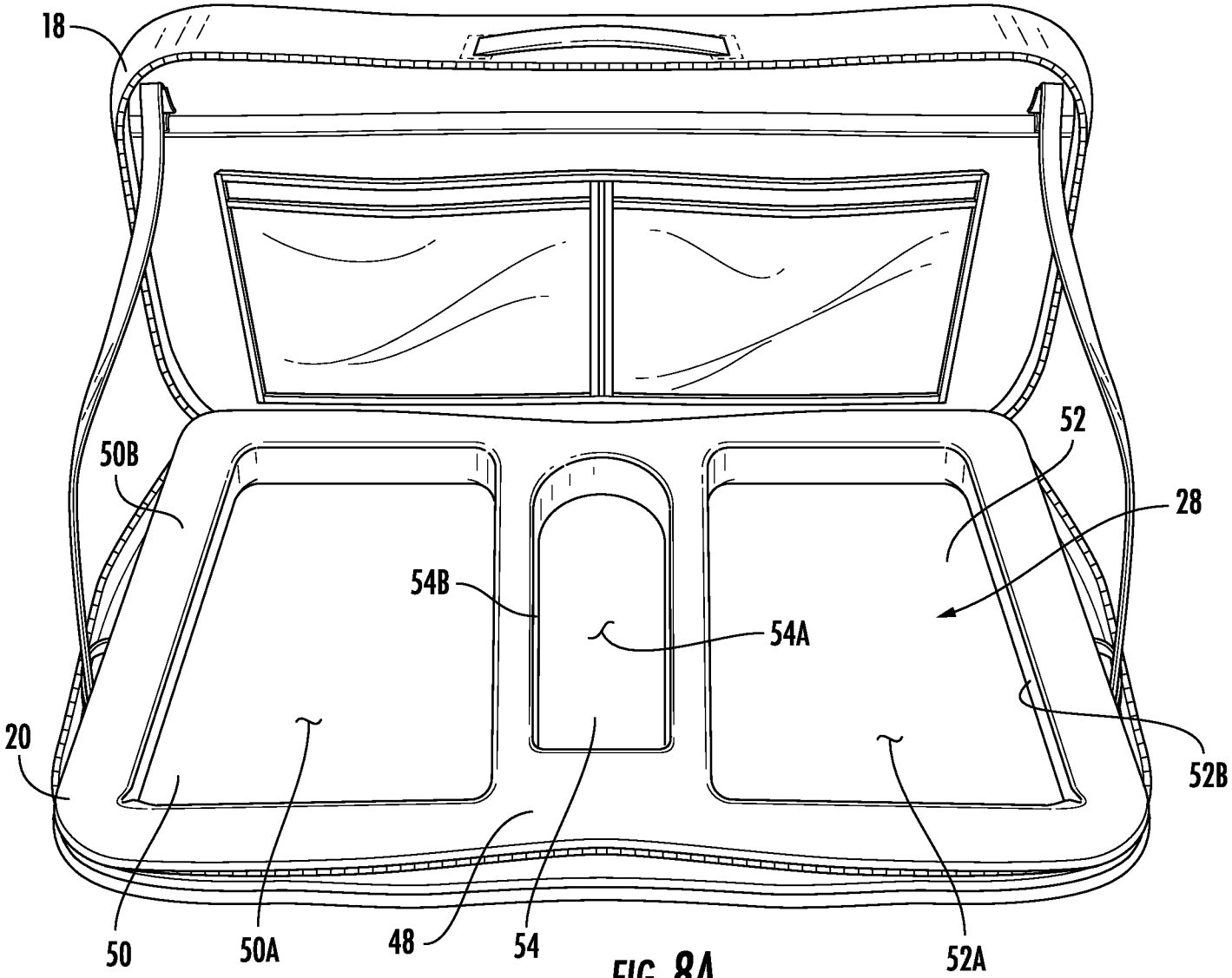
FIG. 8A illustrates the cushion storage device in an open configuration.

The main body 12 may be constructed as a two-piece unit having a first member 18 (also referred to as an upper wall, i.e. the wall not in contact with a cooler when attached to the cooler) and a second member 20 (also referred to as a lower wall, i.e. the wall in contact with a cooler when attached to the cooler), see FIGS. 4 and 5. The first member 18 and the second member 20 are separated by, and at least partially secured together by, a main body fastening member 22, illustrated herein as a zipper system (zipper track 24 and zipper pulls 26). The first member 18 and the second member 20 are constructed and arranged to fit together, enclosing an interior 28, see FIG. 8A. When secured together in a closed position, the main body 12 may further be defined by a front surface 30, see FIG. 1 or FIG. 5, a back surface 32, see FIG. 4, a left, side surface 34, see FIG. 6, and a right, side surface 36, see FIG. 7. In an illustrative example, the first member or upper wall 18 may be constructed of a high-density foam encased in marine grade vinyl. The second member or lower wall 20 may be constructed of a high-density foam encased in marine grade vinyl.

Preferably, the main body 12 is constructed having a clam shell configuration, where the first member or upper wall 18 is secured or attached to the second member or lower wall 20 at some portion. As illustrated in FIG. 4, along a portion of the back surface 32, the first member or upper wall 18 secures to the second member or lower wall 20 via a material, 38, thus forming a hinge. In this configuration, a user may open the first member 18 relative to the second member 20 (when the cushion storage device 10 is secured to a cooler, or vice versa if not attached to a cooler). To prevent the first member 18 from opening or separating from the second member 20 by a predetermined length, the first member 18 may be attached to the second member via a cord or strap 40, see FIG. 9. The cord or strap 40 has an elongated body 42 having a first end 44 secured to a portion of the first member 18, and a second end 46 secured to a portion of the second member 20. The first end 44 and the second end 46 may be secured to the first member 18 or the second member 20 using known fastening techniques, such as mechanical fastening members, such as staples, buttons, snaps, stitching, loop and hook fastening, or chemical fastening, such as glue.

Figure 8B:
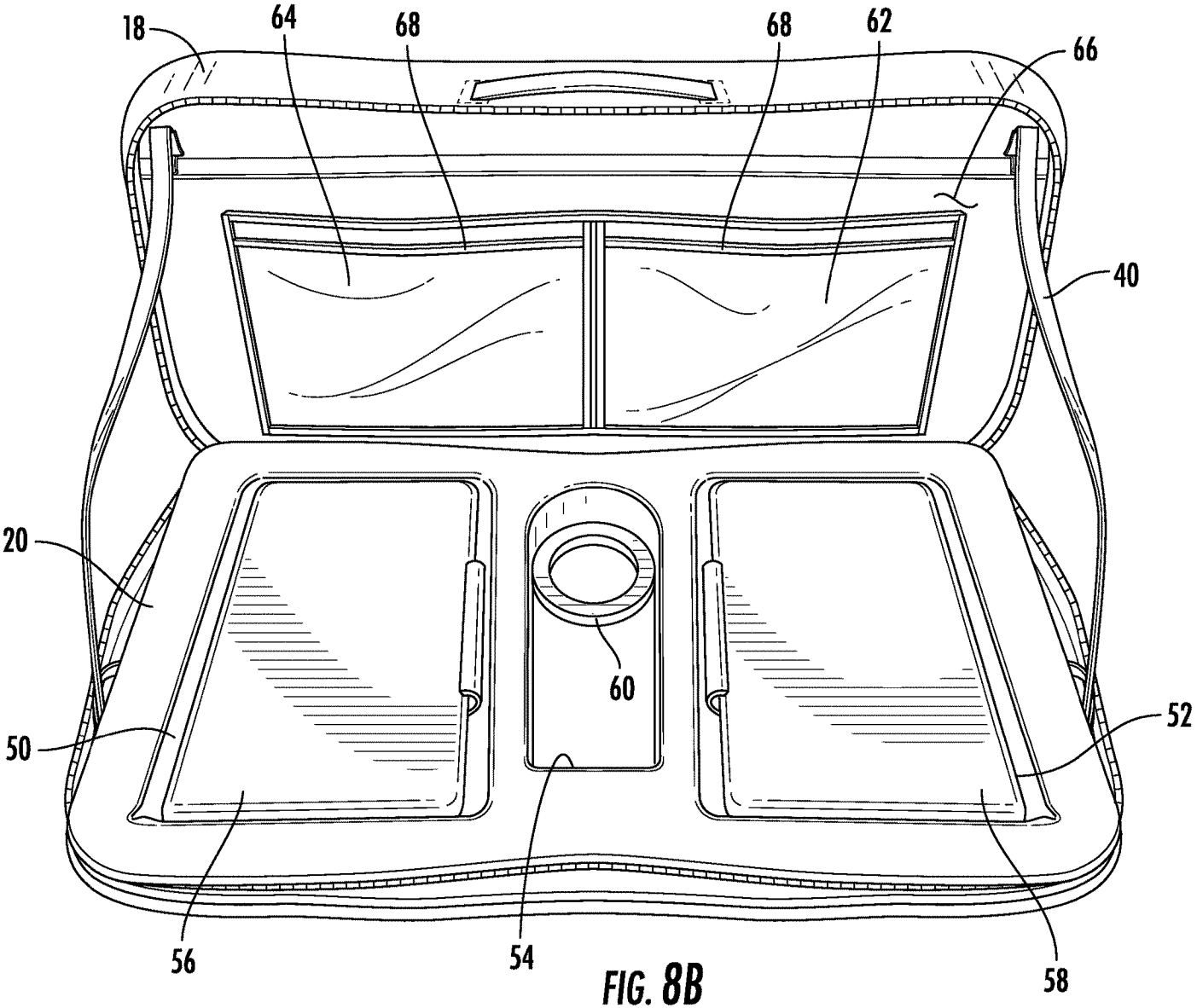
FIG. 8B illustrates the cushion storage device in an open configuration with items stored therein.

Referring back to FIG. 8A, the interior 28 is illustrated having an interior storage tray 48. The interior storage tray 48 is constructed and arranged to store variously shaped items or objects. As illustrated in the figure, the interior storage tray 48 includes a first storage compartment area 50 (defined by shaped bottom surface 50A surrounded by side wall(s) 50B), a second storage compartment area 52 (defined by a shaped bottom surface 52A surrounded by side wall(s) 52B), and a third storage compartment area 54 (defined by a shaped bottom surface 54A surrounded by side wall(s) 54B) placed in-between the first storage compartment area 50 and the second storage compartment area 52. The first storage compartment area 50 may be sized and shaped to secure a tackle box 56 therein, see FIG. 8B. The second storage compartment area 52 may be sized and shaped to secure a second, independent tackle box 58 therein. The third storage compartment area 54, being smaller than the first storage compartment area 50 and the second storage compartment area 52, may be sized and shaped to receive and hold a fishing leader spool 60. While shown with three storage compartment areas, embodiments of the cushion storage device 10 may include an interior 28 having less than three, i.e. one or two storage compartment areas, or any number greater than three storage compartment areas. Additional storage compartments, 62, 64, are positioned on the interior surface 66 of the upper wall 18. The storage compartments 62 and 64 are made of a see-through plastic, forming a pocket, with zipper closures 68.

Figure 8C:
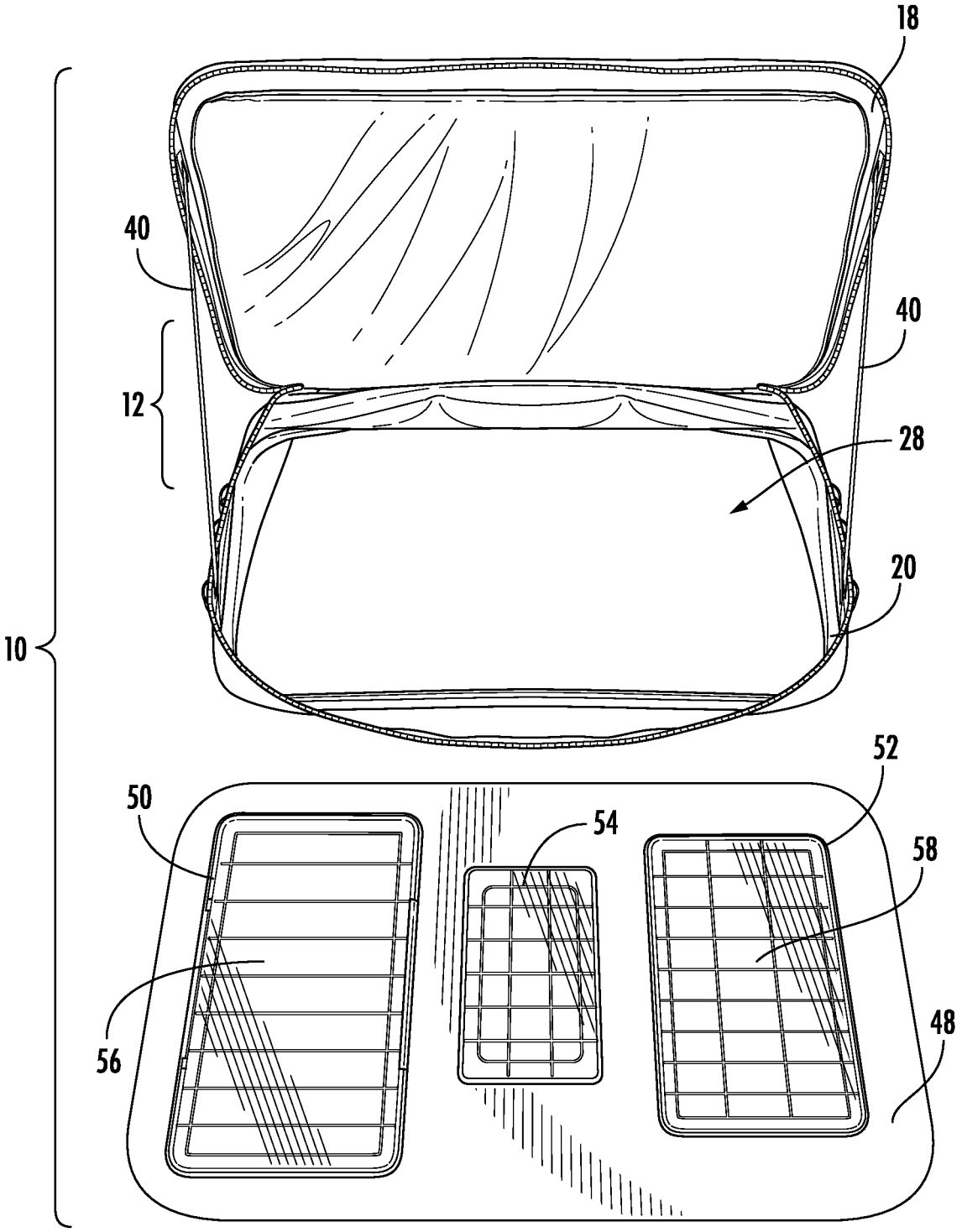
FIG. 8C illustrates the cushion storage device having a removable storage compartment.

The interior storage tray 48 may be designed as an independent unit (not integrally formed to or attached to the interior), see FIG. 8C. In this construction, the interior storage tray 48 can be removed or added as needed.

The cushion storage device 10 is designed to engage with a cooler to 1) allow for additional storage of items and 2) provide seating. Accordingly, when engaged with a cooler, an individual may sit on the main body first surface 14. To aid in engaging with a cooler, and securing thereto, the cushion storage device 10 includes an external structure engagement system 70 constructed and arranged to provide a mechanism to secure the cushion storage device 10 to the cooler (or any independent device or structure), see FIG. 3. The external structure engagement system 70 may be composed of a structure securing member 72, illustrated herein as a cord or cable extending around a perimeter of the bottom surface 16. The cord or cable 72 is preferably made of a flexible, stretchable, and expandable material, thus allowing a user to expand the cord or cable 72 from a first resting position to a second extended position. Accordingly, the cord or cable 72 material can be made of a material that maintains its shape and position when in the resting (non-engaged) position, but expands or stretches when a force is applied thereto. When a force is no longer applied, the cord or cable 72 returns to its first, or non-engaged, positioning.

Figure 3:
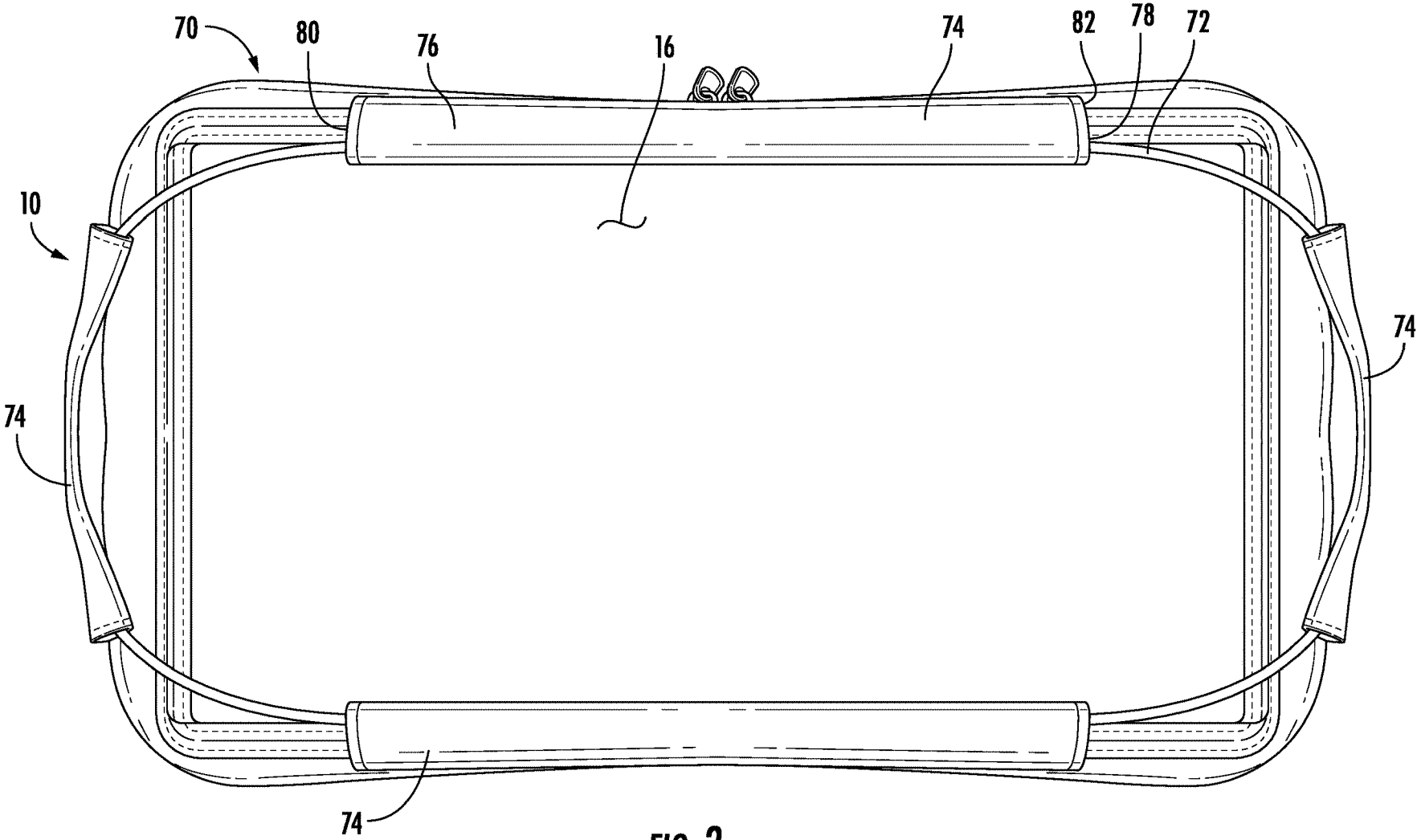
FIG. 3 is a bottom view of the cushion storage device.

The external structure engagement system 70 may further include a structure securing member housing 74, constructed and arranged to secure and hold therein the structure securing member 72. As illustrated in FIG. 3, the cushion storage device 10 includes four (4) structure securing member housings 74, spaced apart and arranged along the perimeter of the main body second surface 16. Each structure securing member housing 74 comprises a body 76 having an interior section 78 of a sufficient size and shape to receive and hold the structure securing member 72, a first opening 80, and a second opposing opening 82. The structure securing member housing 74 may be an independent structure attached to the second member 20, extending away from the second surface 16. Alternatively, the structure securing member housing 74 may be integrally formed from the second member 20. While the external structure engagement system 70 is illustrated using a cord or cable as an example of the structure securing member 72, other mechanisms known to one of skill in the art, such as hook and loop fasteners (VELCRO), buttons, snaps, brackets, zippers, may be used.

Figure 10:
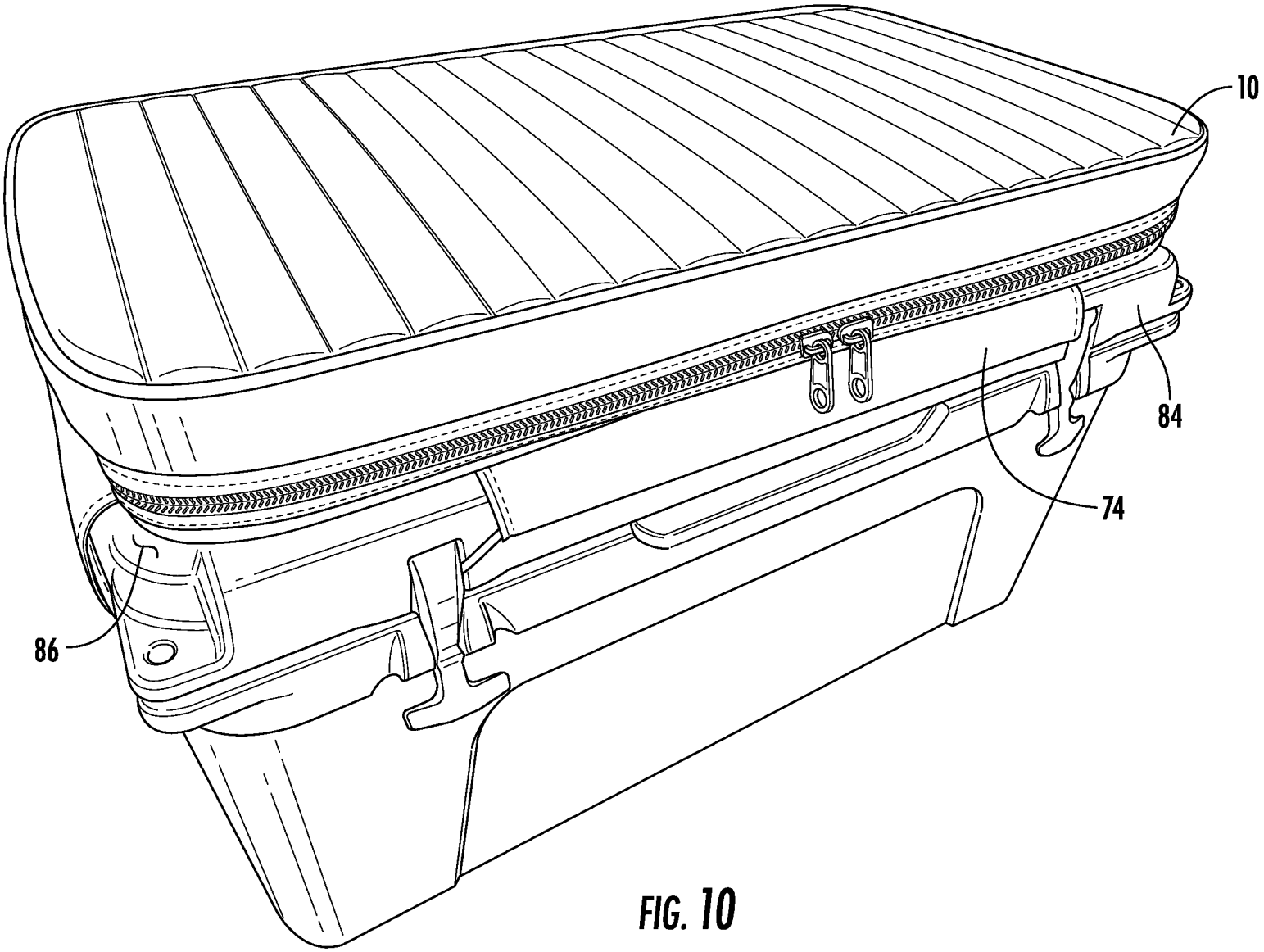
FIG. 10 illustrates the cushion storage device secured to a cooler.
Figure 11:
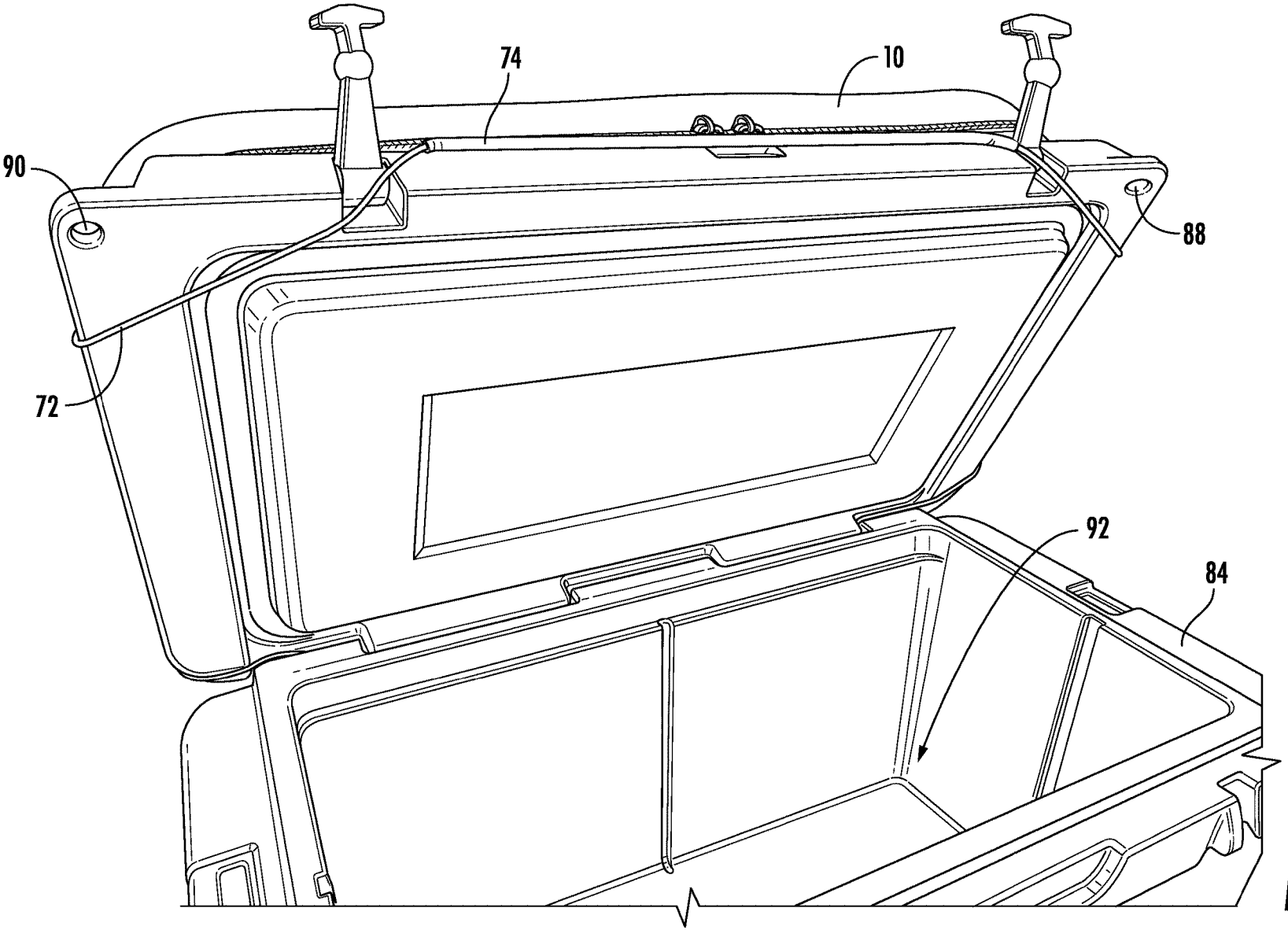
FIG. 11 illustrates an embodiment of a securing mechanism for securing the cushion storage device to the cooler.

Referring to FIGS. 10 and 11, the cushion storage device 10 is shown secured to a cooler 84 (illustrated herein as a YETI cooler). As illustrated, the cushion storage device 10 is orientated to rest on the upper surface 86 of the cooler 84, see FIG. 10. FIG. 11 illustrates the attachment of the storage device 10 to the cooler 84 at corners 88 and 90 of the cooler 84. The cord or cable 72 is illustrated in an extended position, engaging with and securing to the cooler 84 at its corners 88 and 90. Once secured, a user has the option of, 1) opening the cooler 84 to obtain objects stored in the interior 92 (see FIG. 11), sit on top of the attached/secured cushion storage device 10, or 3) open the cushion storage device 10 (via manipulation of the zipper pulls 26), thus exposing the cushion storage device interior 28.

Figure 9:
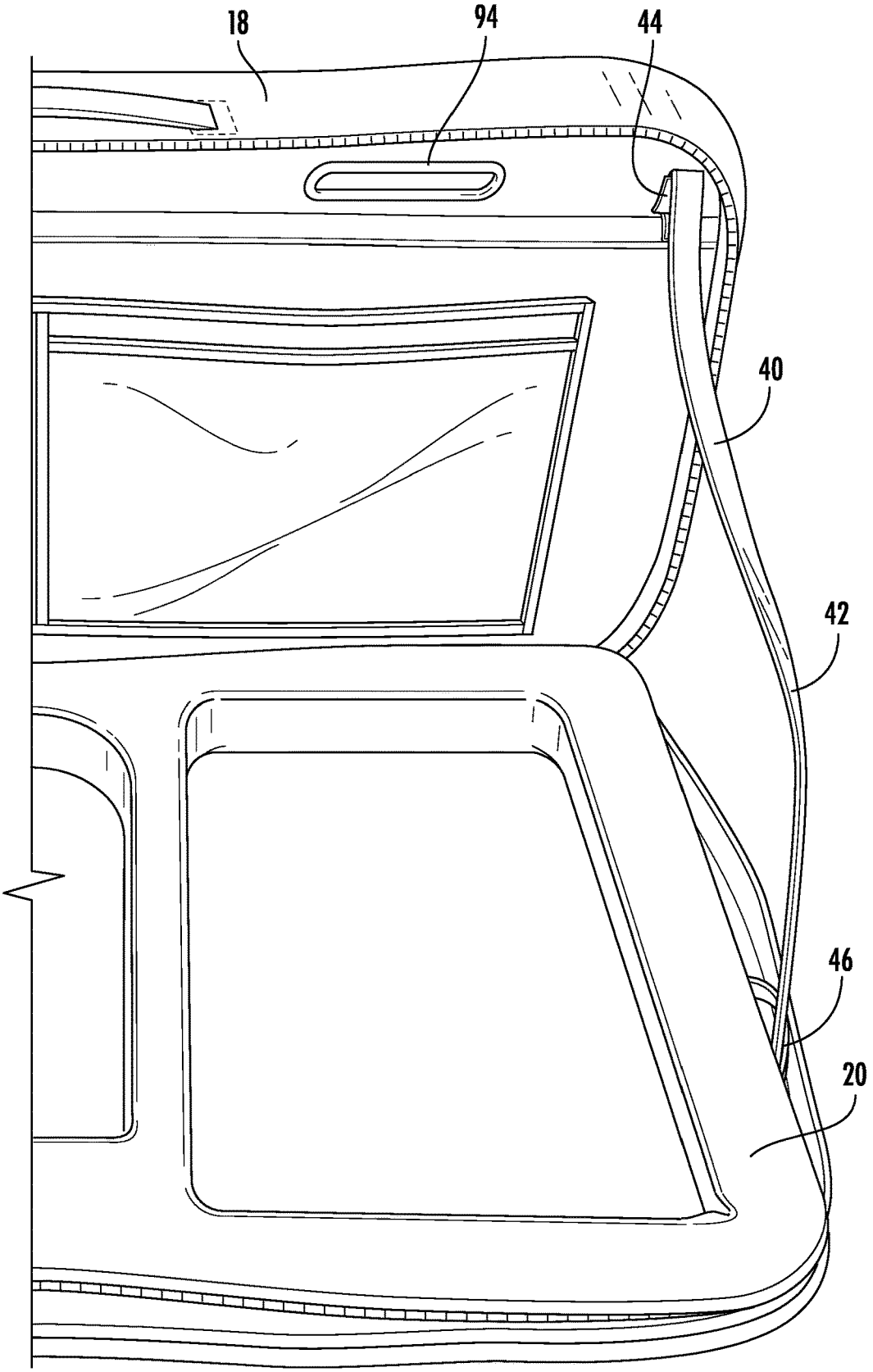
FIG. 9 is a partial view of the cushion storage device illustrating a cord securing portions of the cushion storage device together.

Optionally, the cushion storage device 10 may include an illumination device 94, illustrated herein as a light bulb, see FIG. 9. The illumination device 94 may be battery operated and include a motion sensor designed to turn on when the upper wall 18 (or bottom wall 20, if attached thereto) moves (via being opened). The illumination device 94 may include a timer to automatically turn off if no motion is detected after a predetermined time period.

Figure 12:
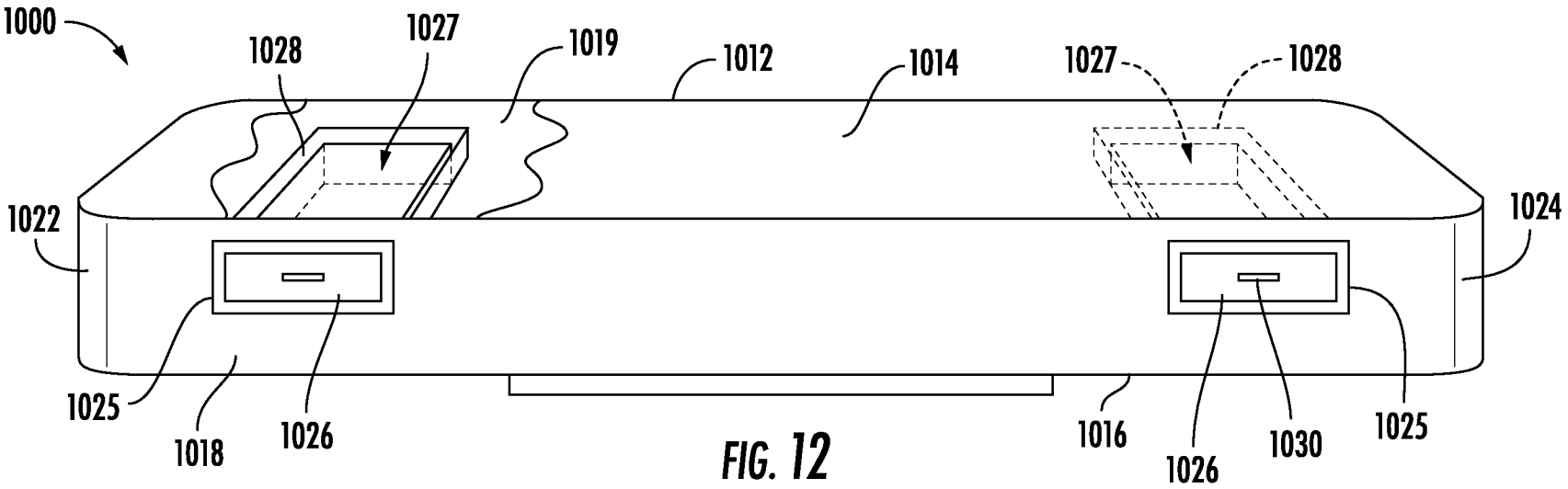
FIG. 12 is a perspective view of an alternative embodiment of the cushion storage device having storage units along a long side.
Figure 13:
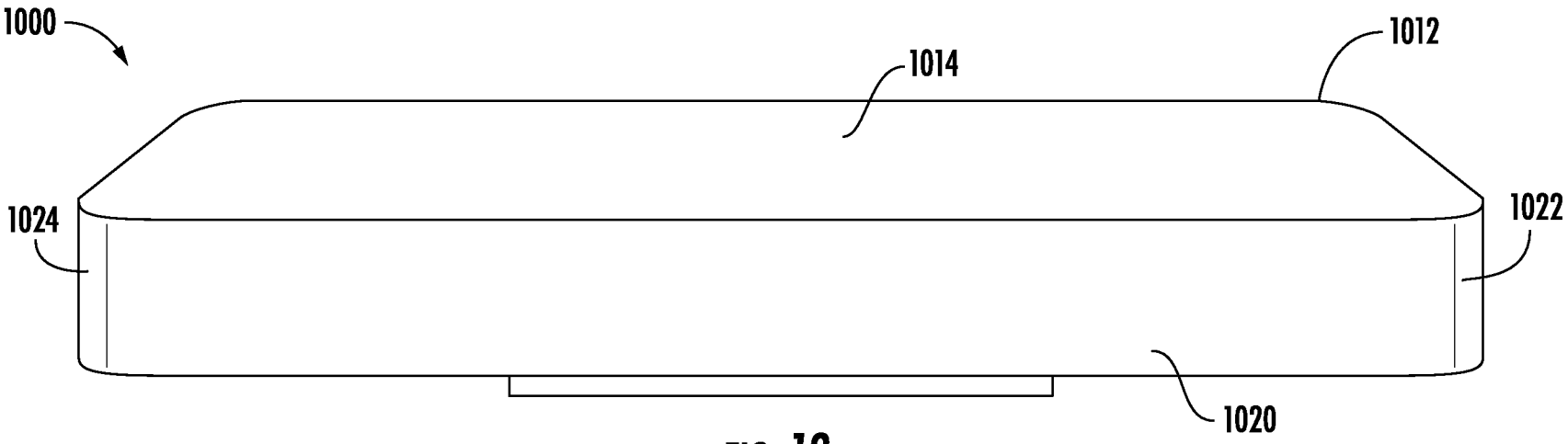
FIG. 13 is an alternative perspective view of the cushion storage device illustrated in FIG. 12.

Referring to FIGS. 12 and 13, an alternative embodiment of the cushion storage device, referred to generally as a cushion storage device 1000 is shown. The cushion storage device 1000 may have many of the same features and functions as that described for the cushion storage device 10, differing mainly in assuming a non-clam shell configuration. Accordingly, the cushion storage device 1000 may be secured to a cooler or other structures, as described for the storage device 10. The cushion storage device 1000 is preferably a single unit having a main body 1012.

The cushion storage device main body 1012 may comprise a first or upper surface or wall 1014, a second opposing lower surface or wall 1016, a front surface or wall 1018, a back surface or wall 1020, and two side surfaces or walls, a left side surface or wall 1022 and a right side surface or wall 1024. The cushion storage device main body 1012 may be constructed of a high-density foam encased in marine grade vinyl. Similar to the storage device 10, which utilizes an interior storage tray 48 constructed and arranged to store variously shaped items or objects, the cushion storage device 1000 is configured to store one or more objects as well. Along the front surface or wall 1018, one or more storage compartments 1026 are provided. As illustrated in FIG. 12, two storage compartments 1026 are shown inserted within openings 1025.

Figure 16:
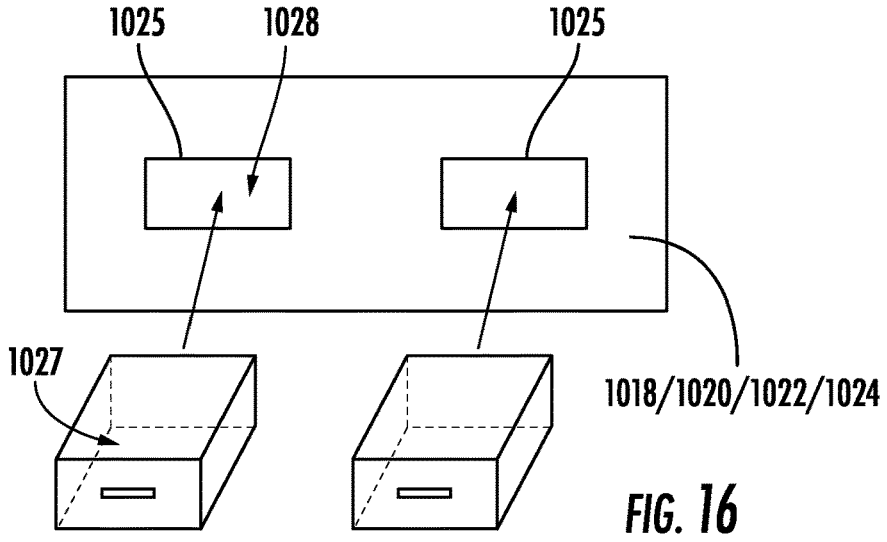
FIG. 16 illustrates the storage units removed from the cushion storage device.

In an illustrative example, the one or more storage compartments 1026 may be an enclosed storage box with a lid. Alternatively, the one or more storage compartments 1026 may be a drawer. For illustrative purposes, a portion of the first or upper surface or wall 1014 is removed, see reference number 1019, where the left storage compartment 1026 is located. Rather than an interior tray, the one or more storage compartments 1026 (with an interior region 1027, (see FIGS. 12, 14, and 16) are designed to be inserted within the cushion storage device main body interior compartment(s) 1028 (see FIGS. 12, 14, and 16), similar to a drawer. The storage compartments 1026 may be placed on a track (not illustrated) to move in and out) or may be designed to snap fit/fictional fit or be pushed in or pulled out of the one or more internal cavities or spaces 1028 defining a cushion storage device main body interior compartment(s). Each of the one or more storage compartments 1026 may include a handle 1030 for easy gripping. The one or more internal cavities or spaces 1028 may be sized to extend from the front surface or wall 1018 to the back surface or wall 1020, or any length therebetween.

Figure 14:
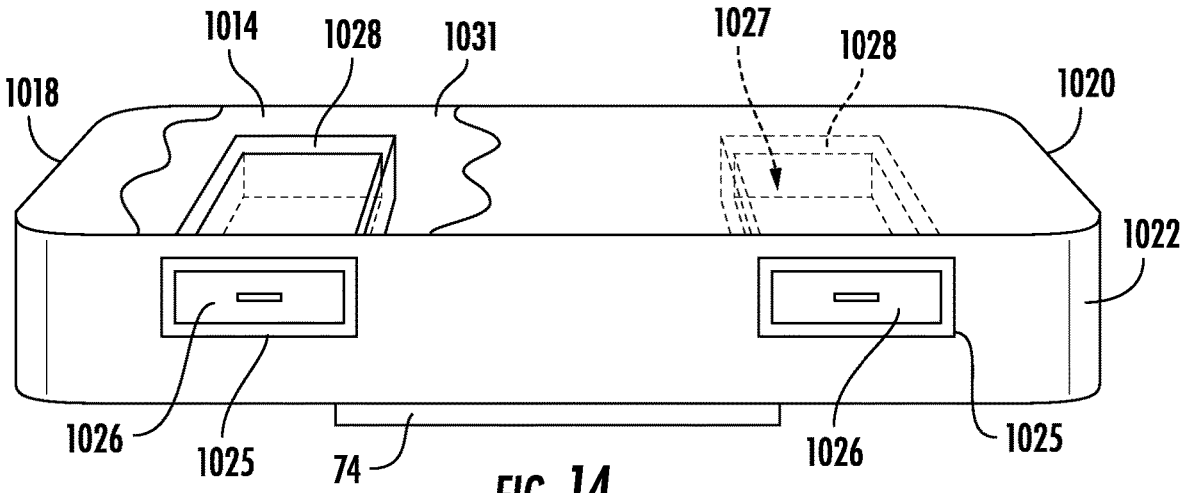
FIG. 14 is a perspective view of an alternative embodiment of the cushion storage device having storage units along a short side.
Figure 15:
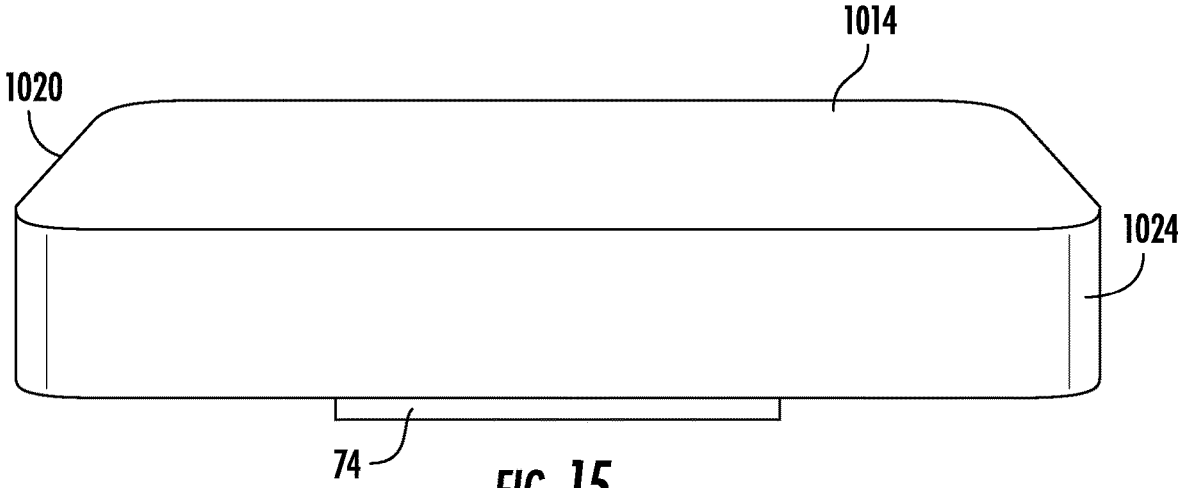
FIG. 15 is an alternative perspective view of the cushion storage device illustrated in FIG. 12.

Referring to FIGS. 14 and 15, the cushion storage device main body 1012 may be designed to have the one or more storage compartments 1026 in the left side surface or wall 1022 (or the right side surface or wall 1024). As illustrated in FIG. 14, two storage compartments 1026 are shown. A portion of the first or upper surface or wall 1014 is removed, see reference number 1031, where the left storage compartment 1026 is located. The one or more internal cavities or spaces 1028 may be sized to extend from the left side surface or wall 1022 to the right side surface or wall 1024, or any length in between.

Figure 17A:
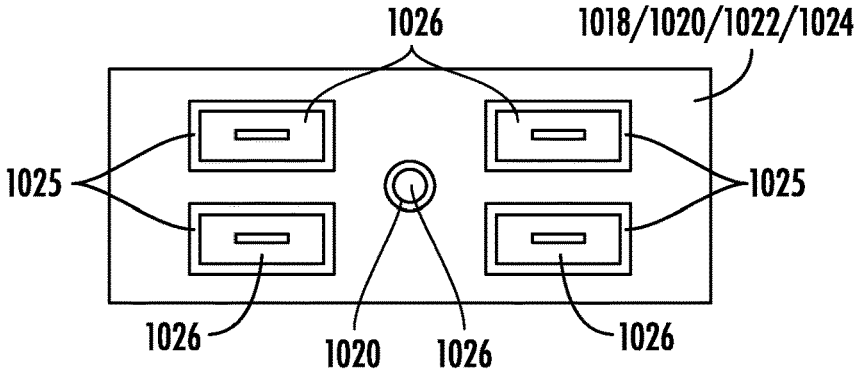
FIG. 17A illustrates an embodiment of the cushion storage device having multiple storage units.
Figure 17B:
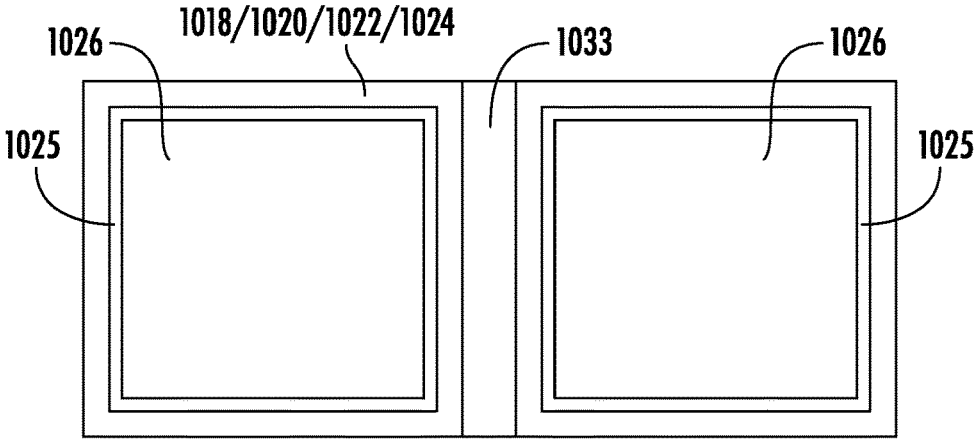
FIG. 17B illustrates an embodiment of the cushion storage device having multiple storage units.

While illustrated with two storage compartments 1026, the cushion storage device 1000 may include more than two storage compartments 1026. In FIG. 17A, the cushion storage device 1000 is illustrated having four rectangular shaped storage compartments. In certain embodiments, the cushion storage device 1000 may include only one storage compartment 1026. The cushion storage device 1000 may also be configured to include two storage compartments 1026, separated by a divider or wall 1033, with the size of the storage compartments 1026 having a size which assumes most (for example at least 90%) of the front surface or wall 1018 (or the back surface or wall 1020, the left side surface or wall 1022, or the right side surface or wall 1024), see FIG. 17B.

Figure 18:
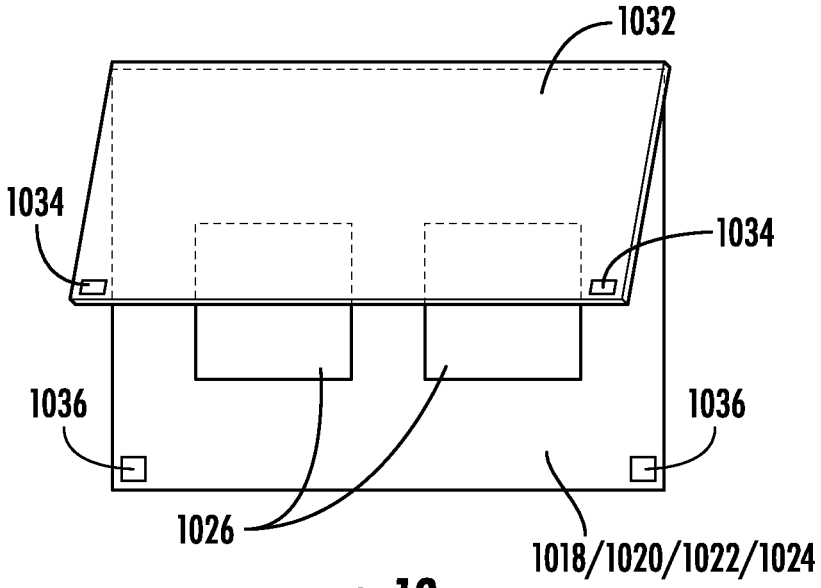
FIG. 18 illustrates the cushion storage device with an illustrative embodiment of a cover to cover the storage units.
Figure 19:
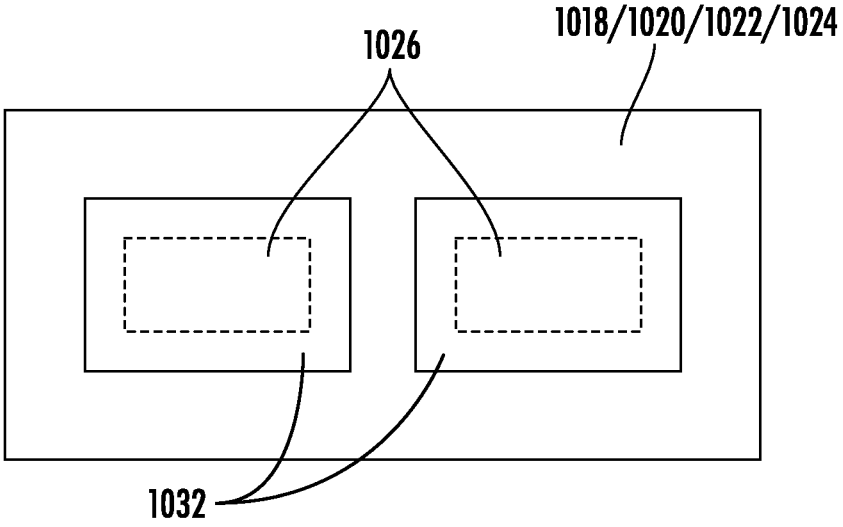
FIG. 19 illustrates the cushion storage device with an alternative embodiment of a cover to cover the storage units.

To prevent the one or more storage compartments 1026 from sliding or moving out prematurely or inadvertently, an access panel 1032 may be used, see FIG. 18. The access panel 1032 may cover the entire surface and be attached to the front surface or wall 1018 (or the back surface or wall 1020, or the left side surface or wall 1022, or the right side surface or wall 1024) via a securing member 1034, such as a button or snap, hook and loop fasteners (VELCRO), that secures to a corresponding securing member receiving member 1036 within the front surface or wall 1018 (or the back surface or wall 1020, or the left side surface or wall 1022, or the right side surface or wall 1024). An alternative securing member 1034 may include a zipper system. Alternatively, the one or more storage compartments 1026 may be covered with individual access panels 1032, secured in place by buttons, hook and loop fasteners (VELCRO), snaps or a zipper, see FIG. 19.

Similar to the cushion storage device 10, the cushion storage device 1000 is designed to engage with a cooler 1) to allow for additional storage of items and 2) provide seating. Accordingly, when engaged with a cooler, an individual may sit on the main body first or upper surface or wall 1014. To aid in engaging with a cooler 84, the cushion storage device 1000 includes the same external structure engagement system 70, constructed and arranged to provide a mechanism to secure the cushion storage device 1000 to an independent device or structure, as described for the cushion storage device 10, or other mechanisms known to one of skill in the art, such as hook and loop fasteners (VELCRO), buttons, zippers.

Figure 20:
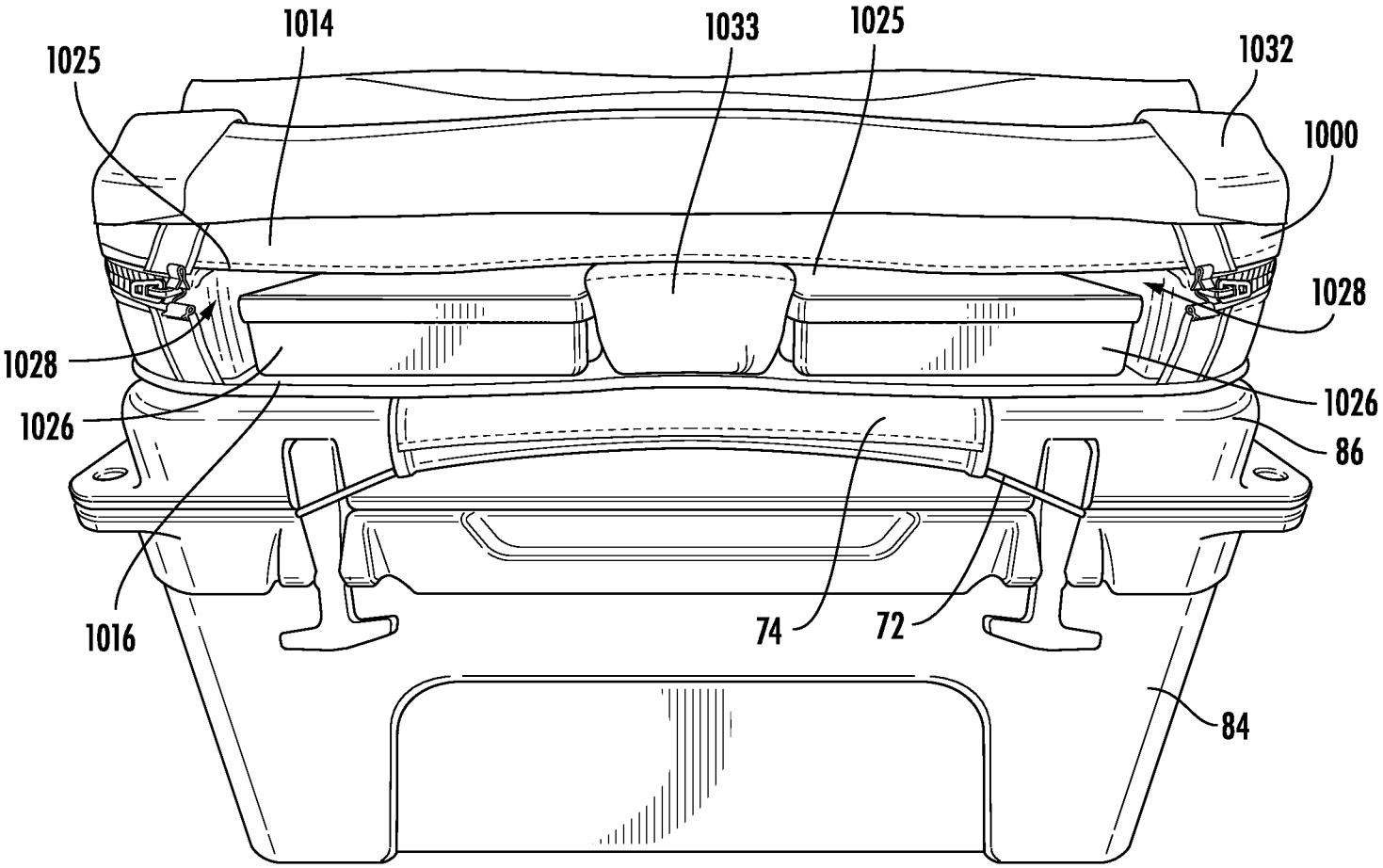
FIG. 20 illustrates the cushion storage device embodiment described in FIG. 14 secured to a cooler with an access panel in the up position.
Figure 21:
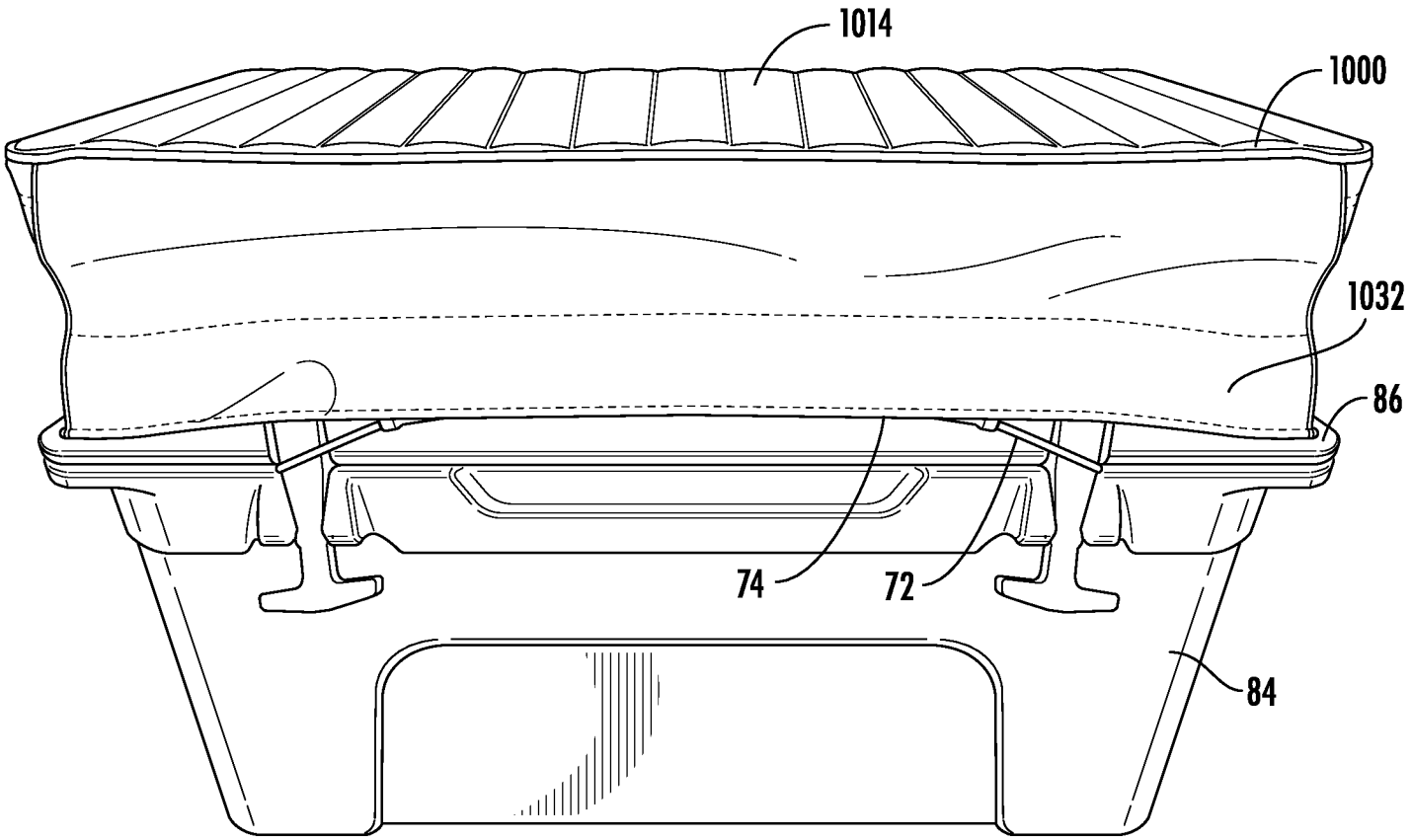
FIG. 21 illustrates the cushion storage device embodiment described in FIG. 14 secured to a cooler with the access panel in a down position.

FIG. 20 illustrates the cushion storage device 1000 secured to the cooler (PATHFINDER) with the access panel 1032 in an up position. In this position, a user can insert/remove the storage compartments 1026 through the openings 1025, and place/remove the storage compartments 1026 into/from the interior compartment(s) 1028. Once removed from or placed inside, the access panel 1032 can be placed in the down position, covering the openings 1025, see FIG. 21.

Embodiments of the cushion storage device 1000 may include a main body 1012 having the one or more storage compartments 1026 in the front surface or wall 1018 (or the back surface or wall 1020) and in the left side surface or wall 1022 (or the right side surface or wall 1024).

Figure 22:
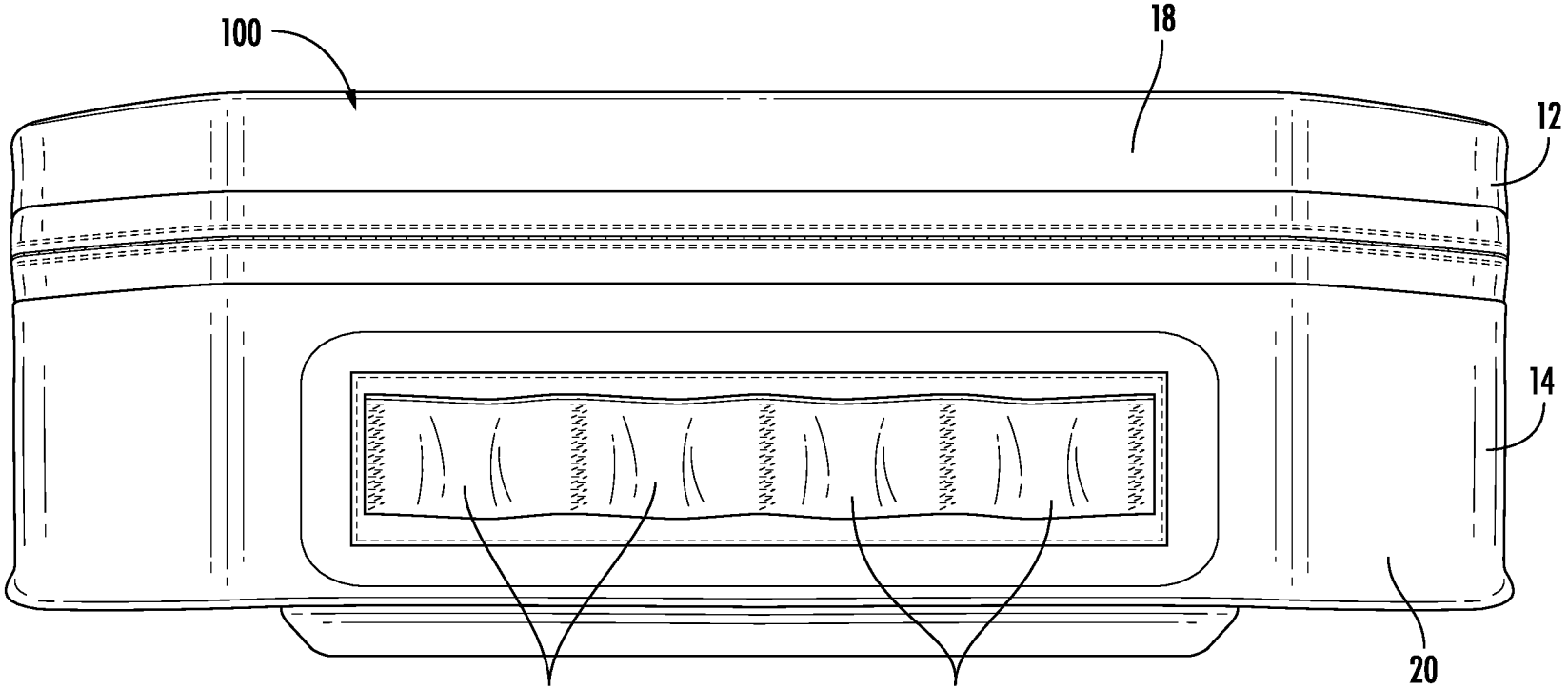
FIG. 22 illustrates the cushion storage device having tool securing members.

FIG. 22 illustrates the cushion storage device 10 (or 1000) having an object securing member 96, illustrated herein as multiple looped materials, arranged in a row and secured to the second member 20 of the main body 14 (or the second wall or surface 1024 of the main body 1012 of the cushion storage device 1000). The object securing members 96 may be sized and shaped to hold various objects, such as tools.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary, and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A cushion storage device for attachment to a secondary device or structure, comprising:

a main body having a first member defining an upper surface and a second member defining a second, opposing lower surface, said first member and said second member arranged to enclose an interior;

said interior constructed and arranged to secure or hold one or more items;

an external structure engagement system constructed and arranged to secure said main body to a secondary device or structure comprising a lid having four corners, said external structure engagement system comprising an expandable securing member placed along a bottom perimeter of said second member, said expandable securing member providing four points of connections with said lid, one connection point at each corner of said lid, said expandable securing member made of a material which expands from a first resting position to a second extended position when a force is applied and returns to said first position when said force is removed.

2. The cushion storage device for attachment to a secondary device or structure according to claim 1, wherein said interior includes at least one storage compartment.

3. The cushion storage device for attachment to a secondary device or structure according to claim 1, wherein said main body first member and said main body second member are secured together by a fastening member.

4. The cushion storage device for attachment to a secondary device or structure according to claim 3, wherein said fastening member is a zipper system.

5. The cushion storage device for attachment to a secondary device or structure according to claim 1, wherein said main body first member comprises a high-density foam and said main body second member comprises a high-density foam.

6. The cushion storage device for attachment to a secondary device or structure according to claim 5, wherein, said main body first member high-density foam is encased within a material, and said main body second member high-density foam is encased within a material.

7. The cushion storage device for attachment to a secondary device or structure according to claim 6, wherein, said material is marine grade vinyl.

8. The cushion storage device for attachment to a secondary structure according to claim 1, wherein said first main body member is movable independent of said main body second member, and said main body second member is movable independent of said main body first member.

9. The cushion storage device for attachment to a secondary device or structure according to claim 1, wherein, said main body first member is hingedly attached to said main body second member.

10. The cushion storage device for attachment to a secondary device or structure according to claim 1, further including at least one attachment member linking said main body first member and said main body second member.

11. The cushion storage device for attachment to a secondary device or structure according to claim 10, wherein said at least one attachment member linking said main body first member and said main body second member is a cord or strap.

12. The cushion storage device for attachment to a secondary device or structure according to claim 1, wherein said interior includes a storage tray.

13. The cushion storage device for attachment to a secondary device or structure according to claim 12, wherein said interior storage tray is removable.

14. The cushion storage device for attachment to a secondary device or structure according to claim 1, wherein said interior includes a storage tray comprising at least one storage compartment.

15. The cushion storage device for attachment to a secondary device or structure according to claim 1, wherein said secondary structure is an ice chest or cooler.

16. A cushion storage device for attachment to a secondary device or structure comprising:

a main body having a first surface or wall, a second opposing lower surface or wall, a front surface or wall, a back surface or wall, a left side surface or wall, and a right side surface or wall;

an external structure engagement system constructed and arranged to secure said main body to a secondary device or structure comprising a lid having four corners, said external structure engagement system comprising an expandable securing member placed along a bottom perimeter of said second member, said expandable securing member providing individual connection at each of said four corners of said lid of said secondary device or structure, said expandable securing member made of a material which expands from a first resting position to a second extended position when a force is applied and returns to said first position when said force is removed; and one or more internal cavities or spaces defining one or more storage compartments constructed and arranged to store variously shaped items or objects, each of said one or more storage compartments terminating in an opening within said first surface or wall, said second opposing lower surface or wall, said front surface or wall, said back surface or wall, said left side surface or wall, or said right side surface or wall.

17. The cushion storage device for attachment to a secondary device or structure according to claim 16, further including at least one removable storage compartment, said at least one removable storage compartment is sized and shaped to fit and store within said one or more internal cavities or spaces.

18. The cushion storage device for attachment to a secondary device or structure according to claim 16, wherein said at least one removable storage compartment is a box or drawer.

19. The cushion storage device for attachment to a secondary device or structure according to claim 16, wherein said main body is constructed of a high-density foam encased in a marine grade vinyl outer shell.

20. The cushion storage device for attachment to a secondary device or structure according to claim 16, further including an access panel covering said one or more internal cavities or spaces.

* * * * *